US007062056B2

(12) United States Patent
Jonkman

(10) Patent No.: US 7,062,056 B2
(45) Date of Patent: Jun. 13, 2006

(54) DIRECTIONAL HEARING AID TESTER

(75) Inventor: Jacobus Jonkman, Dorchester (CA)

(73) Assignee: Etymonic Design Incorporated, Dorchester (CA)

( * ) Notice: Subject to any disclaimer, the term of this patent is extended or adjusted under 35 U.S.C. 154(b) by 414 days.

(21) Appl. No.: 10/658,278

(22) Filed: Sep. 10, 2003

(65) Prior Publication Data

US 2005/0053250 A1 Mar. 10, 2005

(51) Int. Cl.
*H04R 29/00* (2006.01)

(52) U.S. Cl. ..... 381/312; 381/60; 73/602; 73/641

(58) Field of Classification Search ..... 381/60, 381/58, 92, 312; 73/584, 602, 641; 702/77, 702/112

See application file for complete search history.

(56) References Cited

U.S. PATENT DOCUMENTS 6,954,535 B1 * 10/2005 Arndt et al. ..... 381/60
2005/0207592 A1 * 9/2005 Sporer et al. ..... 381/95

* cited by examiner

*Primary Examiner*—Sinh Tran
*Assistant Examiner*—Walter F Briney, III
(74) *Attorney, Agent, or Firm*—Bereskin & Parr

(57) ABSTRACT

Method and apparatus for testing a directional acoustic device such as a directional hearing aid having level-dependent non-linear circuitry, in which two or more speakers are placed at desired positions relative to the hearing aid, e.g. in front and behind the hearing aid. The speakers are excited simultaneously with broadband excitation signals formed from components which are orthogonal to each other, e.g. sinusoids, where the bin frequencies of the Direct Fourier Transform ("DFT") of one excitation signal are different from the bin frequencies of the other excitation signal. Thus, the response to each excitation signal can easily be extracted without filtering, allowing the directional characteristics of the hearing aid to be evaluated.

17 Claims, 4 Drawing Sheets

DIRECTIONAL HEARING AID TESTER

FIELD OF THE INVENTION

This invention relates to apparatus and methods for testing directional responding acoustical devices to determine their response to sound stimuli. The directional responding acoustical devices will usually, although not necessarily, be directional hearing aids.

BACKGROUND OF THE INVENTION

Hearing aids are tested by supplying a known acoustical test stimulus to the hearing aid microphone and measuring the resulting output. Increasingly, modern hearing aids employ a combination of directional responding microphones and non-linear signal processing to provide better performance to the end-user. Because the non-linear circuitry often causes both the gain and the frequency response of the hearing aid to be level-dependent, it is not possible to measure an accurate directional response by using (for example) two sound sources, one front-facing (i.e. in front of the hearing aid) and the other rear-facing (i.e. facing the rear of the hearing aid), and separately in time sweeping them through various frequencies. An accurate measurement of the directional characteristic requires that the front-facing and rear-facing acoustical stimuli be presented simultaneously.

Traditionally, directional response testing for directional hearing aids has been performed in an anechoic test space in which the front-facing and rear-facing responses are measured separately, typically by making a front-facing measurement and then rotating the hearing aid 180° in the test space to make the rear-facing measurement. As mentioned, measuring the front-facing and rear-facing responses separately will introduce significant error if the hearing aid has level-dependent gain and frequency shaping circuitry that responds to the overall input level. As an example, the rear-facing signal may be attenuated by the directional microphone by upwards of 10 dB, so when this signal is presented in isolation, the level-dependent circuitry will adapt accordingly to this low-level signal. However, under real-world conditions, the front-facing signal will be present simultaneously with the rear-facing signal and will not be attenuated. This will result in a significantly higher total signal presented to the level-dependent circuitry and consequently the hearing aid will under these conditions have a different gain and frequency response.

Using an anechoic test space presents additional problems. Such space must be large and filled with sound absorbing material to prevent standing waves, and this makes it impractical for use by most hearing aid dispensers. In addition, the responses measured in an anechoic chamber do not accurately reflect the real world performance that might be expected in a typical hard-walled room such as in a home or office environment where standing waves are present. It has not previously been possible to assess the performance of a directional microphone system in a real world echoic environment because it has not been possible to present appropriate front-facing and rear-facing signals simultaneously.

BRIEF SUMMARY OF THE INVENTION

Accordingly, it is an object of the invention to provide a method and apparatus for more accurately testing the directional-response of a hearing aid, even if the hearing aid has level-dependent signal processing circuitry.

In one embodiment the invention provides apparatus for testing a directional responding acoustic device, comprising:

(a) at least first and second sound sources adapted to be placed in first and second positions respectively relative to said device, (b) at least one signal generator coupled to said first and second sound sources for generating a first audio signal applied to said first sound source and a second audio signal simultaneously applied to said second sound source, said first and second sound sources generating simultaneous first and second acoustical signals in response to said first and second audio signals applied thereto, (c) said first and second audio signals and hence said first and second acoustical signals each containing a plurality of orthogonal components, the components of said first audio signal being different from the components of said second audio signal, (d) and an analyzer adapted to be coupled to said device and synchronized with said generator, for analyzing the response of said device to said first and second acoustical signals.

In another embodiment the invention provides a method for testing a directional responding acoustic device, comprising:

(a) generating at least first and second audio signals each containing a plurality of components, the components of said first audio signal being different from the components of said second audio signal and being orthogonal thereto, (b) applying said first and second audio signals to first and second sound sources respectively to produce first and second acoustical signals, (c) exposing said device simultaneously to said first and second acoustical signals to produce a received signal, (d) and analyzing the response of said device to said first and second acoustical signals.

Further objects and advantages of the invention will appear from the following description, taken together with the accompanying drawings.

BRIEF DESCRIPTION OF DRAWINGS

In the drawings:

FIG. 3 is a plot showing the response of the FIG. 1 apparatus with a front excitation signal on;

FIG. 4 is a plot showing the response of the FIG. 1 apparatus with a rear excitation signal on;

FIG. 5 is a plot showing the response of the FIG. 1 apparatus with both the front and rear excitation signals on;

DETAILED DESCRIPTION OF PREFERRED EMBODIMENTS

The preferred embodiment of the invention will be described with reference to testing a directional hearing aid. However, the method and apparatus of the invention may be used with other directional-responding acoustical devices, e.g. microphones, and sound recorders for various applications.

Figure 1:
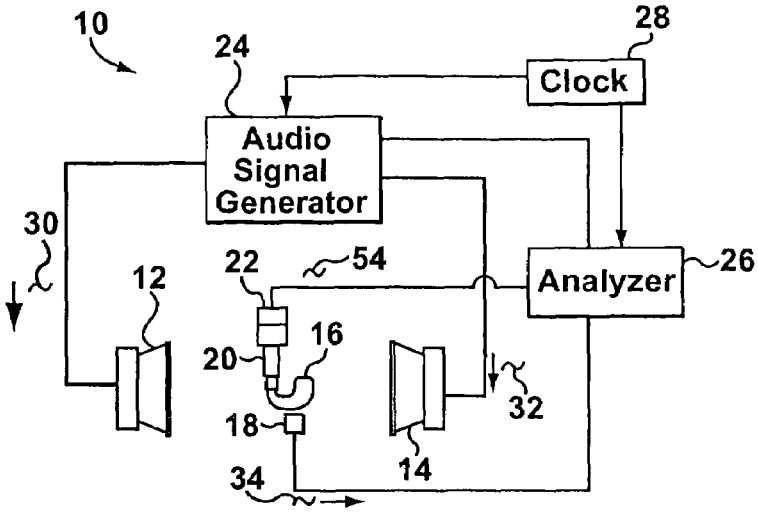
FIG. 1 is a block diagrammatic view of a directional hearing aid test apparatus according to the invention.

As shown in FIG. 1, a test space 10, which can be either an acoustically-treated anechoic space or a non-treated echoic space, contains two spaced apart loudspeakers, namely a first speaker 12 and a second speaker 14. The two loudspeakers are shown as being in the same plane and facing each other, but this configuration is arbitrary and depends on the performance characteristic which is desired to be measured.

The hearing aid 16 to be tested is shown midway between the loudspeakers 12, 14, but the hearing aid 16 can be placed in any desired orientation. Located closely adjacent the hearing aid 16 are a controlling microphone 18 (used for a purpose to be explained), a conventional ear simulator or coupler 20 which is connected to the hearing aid 16, and a measurement microphone 22 which (via the coupler 20) receives the acoustical signal output by the hearing aid 16 (and which acoustical signal would normally be directed into a user's ear).

The loudspeakers 12, 14 are connected to an audio signal generator 24, to be described in more detail, and which generates audio signals to excite each loudspeaker.

The controlling microphone 18 is connected to an analyzer 26, which in turn is connected to and controls the audio signal generator 24. The measurement microphone 22 is also connected to the analyzer 26, for analysis of the hearing aid response.

The audio signal generator 24 is a computer controlled signal generator which is clocked by a clock diagrammatically indicated at 28. The clock 28 also provides a clock signal to the computer controlled analyzer 26, so that the analyzer 26 is synchronized precisely to the generator 24. In fact, the generator 24 and analyzer 26 are normally implemented as one piece of equipment, as will be disclosed.

The generator 24 generates two broadband excitation signals, one for first loudspeaker 12 and the other for the second loudspeaker 14. The first broadband signal, indicated at 30 in FIG. 1, consists of multiple sinusoids which are exact bin frequencies of a Discrete Fourier Transform ("DFT"), but signal 30 does not contain all of the bin frequencies. The second broadband signal, indicated at 32 in FIG. 1, and which is applied to the second loudspeaker 14, is composed of multiple sinusoids which are the unused bin frequencies of the DFT of the first excitation signal 30. Each signal 30, 32 can contain an arbitrary quantity and spacing of bin frequencies, with the important requirement that no bin frequency be common to both signals. A particularly useful configuration is to have one of the audio signals 30, 32 contain the even bin frequencies, and the other contain the odd bin frequencies, so that the bandwidths and spectra of each audio signal are very similar.

The signal 34 appearing at the output of the controlling microphone 18 is a linear combination of the two mathematically orthogonal excitation signals 30, 32. The signal 34 is converted to the frequency domain by the signal analyzer 26 to which controlling microphone 18 is connected, using (in the signal analyzer) a DFT. Once in the frequency domain, the primary and secondary signal DFT bin components are separated by the signal analyzer 26 (a simple task), thereby extracting the received signals corresponding to the primary and secondary excitation signals 30, 32. Since the signal analzyer 26 is connected to the signal generator 24, independent control loops are implemented for each excitation signal 30, 32, so that the level, phase and spectral content of each excitation signal 30, 32 can be precisely controlled.

Figure 2:
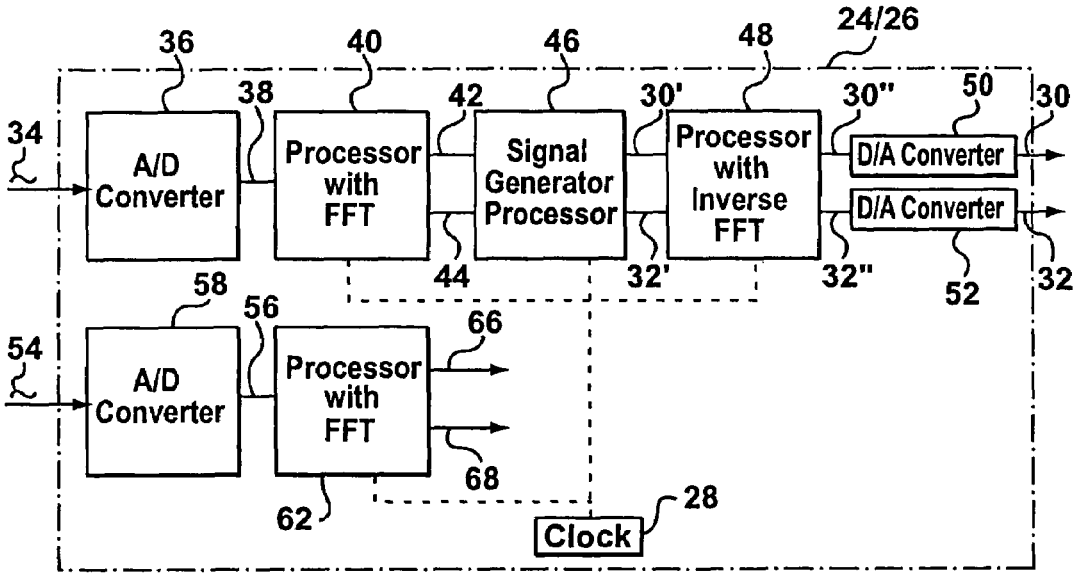
FIG. 2 is a block diagram view of a signal generator/analyzer used in the FIG. 1 apparatus.

In more detail, and as shown in FIG. 2, which shows the analyzer/generator as a single block 24/26, the analogue signal 34 from the controlling microphone 18 is applied to an A/D converter 36 in block 24/26. The resulting digital signal 38 is applied to a processor 40 which implements a Fast Fourier Transform or FFT (which is an efficient means by which to calculate the DFT) to convert signal 35 to two frequency domain signals 42, 44, one containing the bin components of first excitation signal 30 and the other containing the bin components of second excitation signal 32.

Signals 42, 44 are applied to control a signal generator processor 46 (typically the same processing hardware as FFT processor 40) to produce two frequency domain signals 30', 32' corresponding to excitation signals 30, 32. Signals 30', 32' are passed through an inverse FFT processor 48 (again part of the same processor hardware previously mentioned) to producing two time domain digital signals 30", 32"corresponding to excitation signals 30, 32 respectively. Signals 30", 32" are passed through D/A converters 50, 52 to produce the excitation signals 30, 32 (which can be appropriately amplified, by amplifiers not shown). In this way, the excitation signals 30, 32 are controlled to have any desired characteristics. For example, the spectrum of each excitation signal 30, 32 can be made that of "pink noise" (i.e. flat on a logorithmic scale), or the spectrum of each excitation signal can be made that of speech in a crowded room, or to have any other desired shape.

Preferably, the controlling microphone 18 has a flat, non-directional response, but this is not essential since its characteristics can be compensated for as desired.

The acoustic signal (resulting from first and second excitation signals 30, 32) which excites or drives the controlling microphone 18 is also (to a very close approximation) the same as the signal appearing at the hearing aid 16 and which is processed by the hearing aid. If the level of the excitation signals 30, 32 is sufficiently low, the distortion at the hearing aid 16 is negligible. The hearing aid 16 outputs an acoustical signal which is directed through coupler 20 to the measurement microphone 22, which in turn outputs a received audio signal 54. Again, the received signal 54 is essentially a linear combination of the two mathematically orthogonal excitation signals 30, 32. In block 24/26, the received signal 54 is converted to a digital signal 56 by A/D converter 58, and is then converted to a frequency domain signal using FFT processor 62. Processor 62 also separates the primary and secondary signal bin components in such frequency domain signal and provides two output signals 66, 68, one containing the hearing aid's response to primary excitation signal 30, and the other containing the hearing aid's response to secondary excitation signal 32. (As before, processors 62, 64 can be part of the same processing hardware previously mentioned.) The output signals 66, 68 can be viewed on a monitor, or can be printed, or can otherwise be dealt with as desired.

An important feature of the invention is that each sinusoid in each of the excitation signals 30, 32 is precisely on-bin for the DFT and is therefore orthogonal to every other sinusoid. In addition, because the analyzer 26 is precisely synchronized to the generator 24 (as mentioned, they may be integrated as one hardware unit), therefore when a DFT is performed on the received signal 54 from the measurement microphone 22 (after signal 54 is converted into digital signal 56), all the spectral components of the received signal 54 will also fall precisely on-bin, and therefore there will be no smearing of information between frequencies because they are completely orthogonal. Because the signals are orthogonal, no filtering is necessary.

If the excitation signals 30, 32 were generated in the time domain without regard to their DFT frequency bin alignment, and if the received signal were then analyzed with a DFT, the approach would work if the frequencies were sufficiently separated so that the unavoidable frequency smearing effects could be neglected. However, there would be a point at which the smearing would cause the adjacent frequencies to merge into one spectral line and become inseparable. Well-known time domain windowing techniques can reduce the frequency smearing but cannot eliminate it. There would also be unavoidable trade-offs between frequency resolution and amplitude accuracy. Ultimately, there would be severe limits to how closely frequencies can be spaced, and this would limit the ability to create a dense spectrum that can be separated by analysis. In contrast, the method and the apparatus described are less prone to these limitations and separable spectra can be created to most reasonable requirements so long as the generator and analyzer are accurately synchronized.

By way of example, an excitation signal bandwidth (for each excitation signal 30, 32) of 200 Hz to 8 kHz can be provided. This is a bandwidth which is typically used in the measurement of hearing aids. Modest performance conventional hardware can be used which runs at a sample rate of 32 kHz and uses a 4096 point DFT, in which case it is possible to produce approximately 1000 mathematically orthogonal sinusoids in the bandwidth of 200 Hz to 8 kHz. If half of the sinusoids (500) are allocated to the first excitation signal 30, applied to the first speaker 12, and 500 sinusoids are allocated to the second excitation signal 32 for the second speaker 14, then the spectrum can be divided so that odd bin frequencies are allocated to the first excitation signal 30 and even bin frequencies are allocated to the second excitation signal 32. In that case, the spectrum for each excitation signal will have frequency components spaced apart about every 16 Hz, which is sufficiently dense to meet the requirements for testing the broadband directional characteristics of current hearing aids. Some current hearing aids have processing bands as narrow as 100 Hz, so it is evident that the dense spectrum which the invention can achieve is already highly useful. Future hearing aids may require even denser spectrums, which can be achieved relatively easily using the described method and apparatus.

If an application requires a different stimulus spectrum, then the sampling rate for the DFT size, or both, can be scaled to meet the requirements without serious concern about smearing or cross-talk between the excitation signals, because their components are orthogonal and the orthogonality is preserved independent of the scaling, provided that the generator 24 and analyzer 26 are synchronized.

It will be realized that the bin allocations can be changed from the odd/even arrangement described in the example, depending on the desired characteristics to be measured. For example, if a less dense spectrum is required for the second excitation signal 32, then (by way of example only), two-thirds of the bin frequencies can be allocated to the first excitation signal 30 and one of each three can be allocated to the second excitation signal 32.

Reference is next made to FIGS. 3 to 8, which show experimental results generated from the system previously described. To produce the experimental results, the first and second excitation signals 30, 32 were applied simultaneously (to speakers 12 and 14 respectively), and each consisted of approximately 500 sinusoids. Each excitation signal was controlled to have an overall level of 60 dBSPL over a bandwidth of 200 Hz to 8000 Hz as measured by the controlling microphone 18. In FIGS. 3 to 8, the X-axis units are Hz, and the Y-axis are dBSPL.

The responses of FIGS. 3 to 6 were measured at the measurement microphone 22, without a hearing aid present. All measurements for FIGS. 3 to 6 were performed without a coupler attached to the measurement microphone 22.

The responses in FIGS. 3 to 8 are shown in 1/12th octave bands. Since there are a total of 65 such bands in the bandwidth between 200 and 8000 Hz, therefore the response curves are each made up of 65 points.

Figure 3:
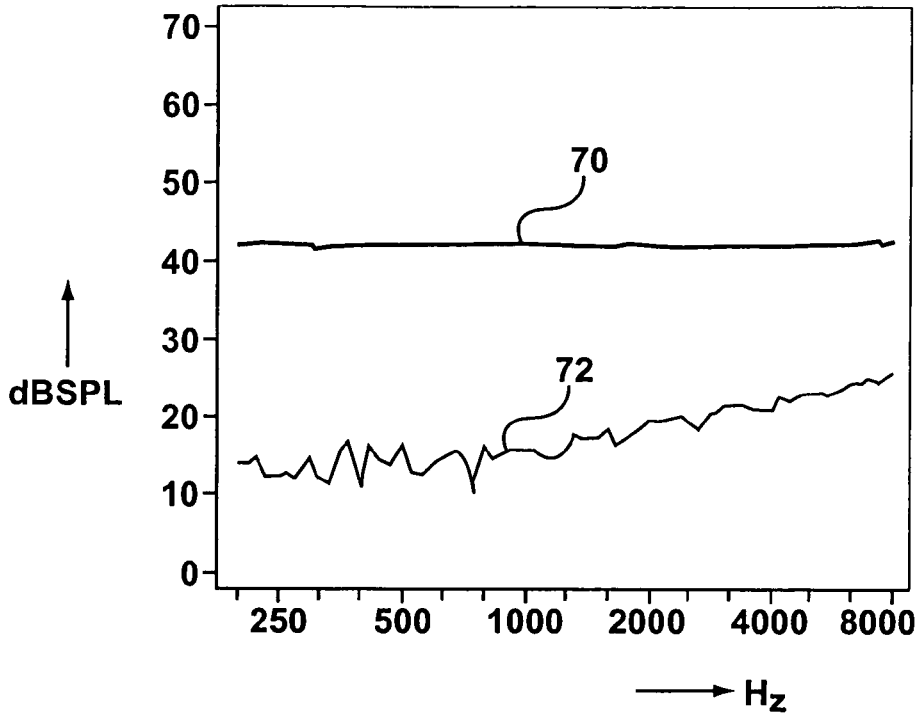

In FIG. 3, the audio signal 30 exciting the front speaker 12 was on, while the audio signal 32 exciting the rear speaker 14 was off. It will be seen that the response 70 resulting from signal 32 accurately measures the 60 dBSPL stimulus, while the response 72 from the rear speaker 14 is shown at 72 and measures the noise floor of the device. There was no interaction between the front and rear signals 30, 32.

Figure 4:
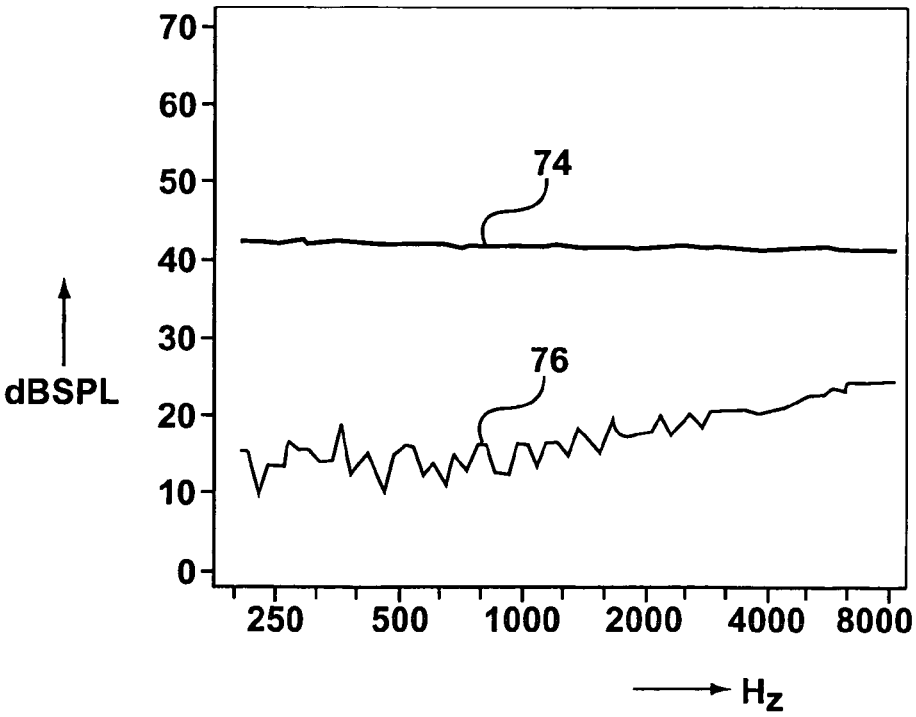

In FIG. 4, the opposite situation prevailed. Rear signal 32 which fed rear speaker 14 was on, while front signal 30 feeding front speaker 12 was off. Curve 74 accurately measures the 60 dBSPL stimulus from the rear speaker 14, while curve 76 resulting from the lack of any signal from the front speaker 12 shows that the device was measuring its noise floor in respect of any signal from the front speaker. There was no interaction between the rear and front signals.

Figure 5:
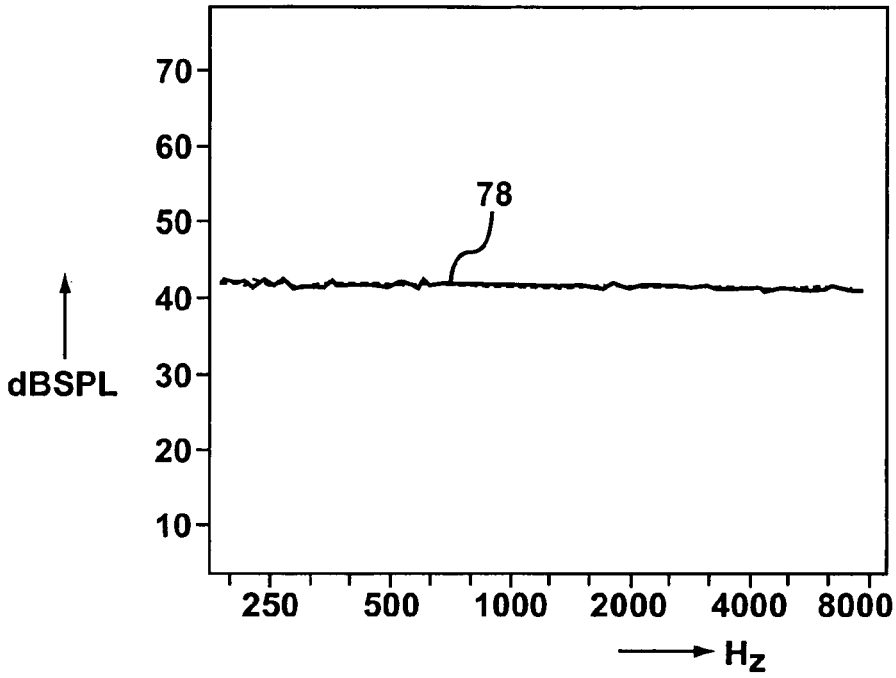

For FIG. 5, both the front and rear signals 30, 32 were on and controlled for the front and rear speakers 12, 14 to output an overall level of 60 dBSPL. The two measured responses, commonly indicated at 78, are essentially overlays (as expected), and it will be seen that they do not interact with each other.

Figure 6:
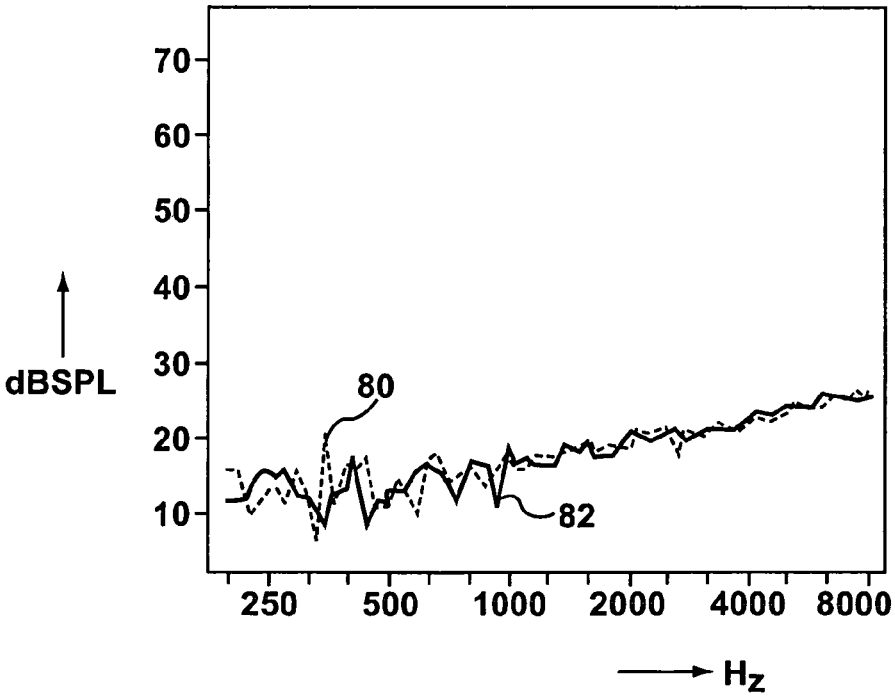
FIG. 6 is a plot showing the response of the FIG. 1 apparatus with both the front and rear excitation signals off.

For FIG. 6, both the front and rear signals 30, 32 were off and the device measured its noise floor as shown by the front and rear response curves 80, 82.

Figure 7:
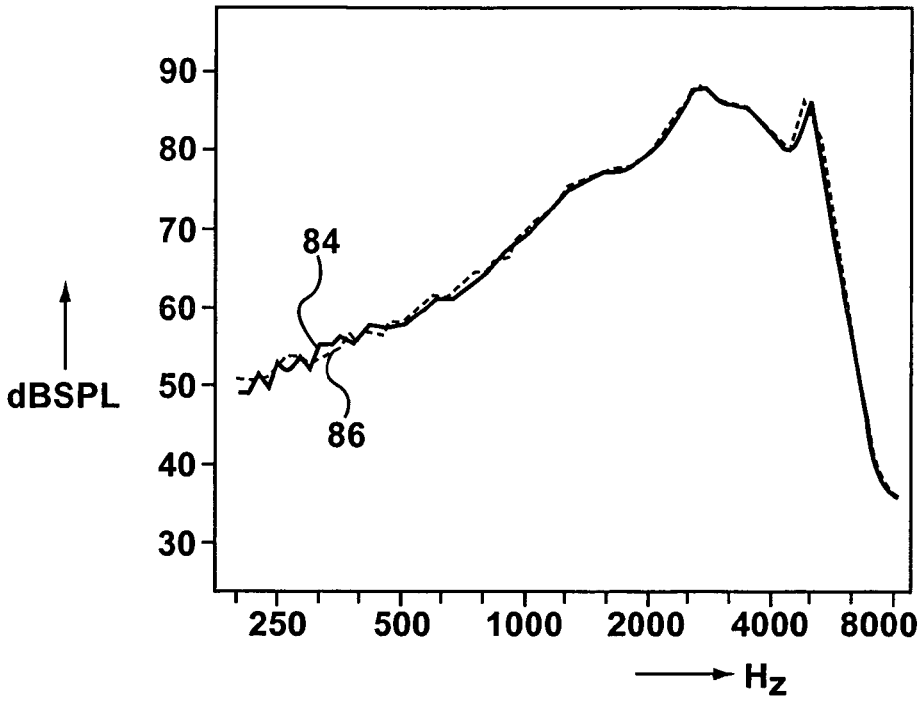
FIG. 7 is a plot showing the response of the FIG. 1 apparatus to the acoustical output signal from a hearing aid operating in a non-directional mode.

For FIG. 7, the measurement microphone 22 was connected to an ANSI HA-2 hearing aid coupler 20. The HA-2 coupler simulates the volume of an average human ear canal. The coupler 20 was connected to a Phonak P2AZ directional hearing aid and the hearing aid was set to its omni-directional (i.e. non-directional) mode. The front and rear response curves are shown at 84, 86, and as expected, they are essentially overlays, i.e. no directional response was seen.

Figure 8:
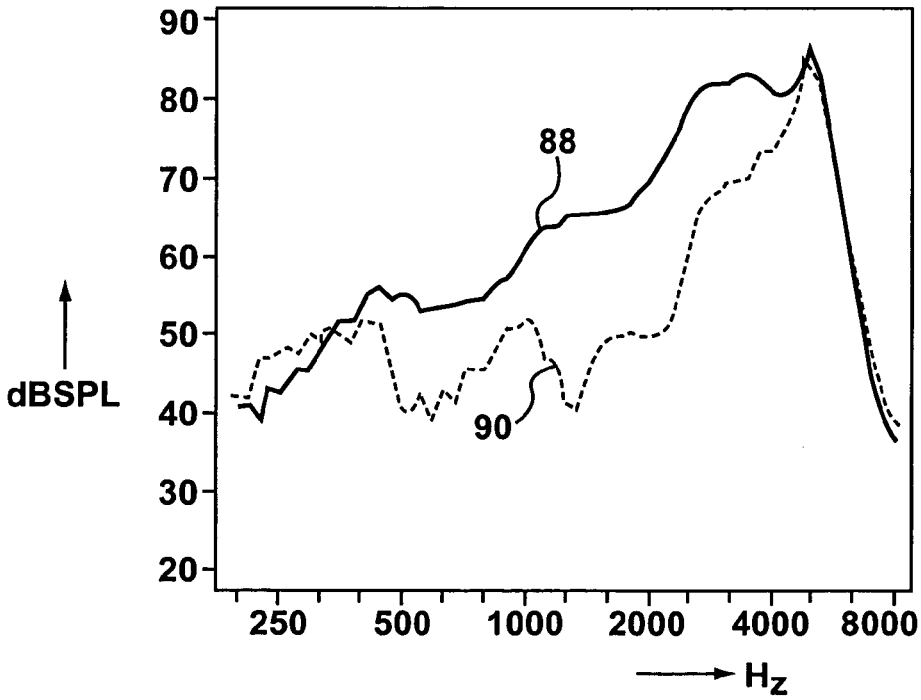
FIG. 8 is a plot showing the response of the FIG. 1 apparatus to the acoustical output of a directional hearing aid set to a directional mode.

FIG. 8 displays the response of the same Phonak P2AZ directional hearing aid when set to its directional mode. The difference in responses to the front and rear signals can clearly be seen in curves 88, 90.

While only two speakers 12, 14 have been shown, driven by two excitation signals 30, 32, the number of speakers can be increased, and the number of excitation signals can also be increased, for example to provide a different excitation signal for each speaker, or to drive two or more speakers with the same excitation signal. As before, the components of each excitation signal will always be orthogonal to each other.

Figure 9:
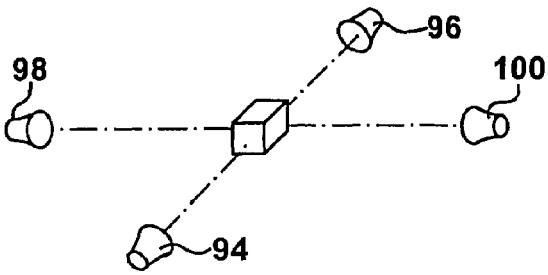
FIG. 9 is a diagrammatic block view showing a modified arrangement according to the invention.

For example, four speakers can be used, or alternatively the directionality characteristics can be measured at quadrature position points on a sphere, such measurement being in real time. An example is shown in FIG. 9, where the hearing aid to be tested, a controlling microphone, and the measurement microphone and coupler connecting it to the hearing aid, are all indicated at block 92. Four speakers 94, 96, 98, 100 are provided, one in front of the hearing aid, one behind it, and one at each side. Each speaker is preferably excited with an excitation signal having bin frequencies different from the bin frequencies of each of the other excitation signals exciting the other speakers. Because the excitation signals are therefore all orthogonal to each other, the response to each excitation signal can easily be separated from the other responses, without filtering.

It will be understood that the term "sinusoid" as used in this description means a signal having the shape of a sine wave, but having any desired amplitude and phase. For example, "sinusoid" includes a cosine wave.

In addition, while it has been assumed that the front and rear signals 30, 32 in the example given both contain bin frequencies from the same DFT, in fact different DFTs can be used, so long as one is an integer multiple or sub-multiple of the other. For example, one can be four times as dense as the other, in which case one of every four bins would coincide. For the coincident bins, only one excitation signal would have a bin frequency from that bin, so that in no cases would the front and rear excitation signals contain any of the same bin frequencies. Since the bin frequencies of the front and rear excitation signals would remain different, the front and rear excitation signals would be orthogonal to each other as before. However, one excitation signal would be much denser than the other.

While sinusoidal wave forms are preferred for the components of the excitation signals, since sinusoids are easy to generate and are orthogonal, other orthogonal signals can be used. For example, Walsh Transforms, which provide square waves, can be used, provided that appropriate square waves are selected so that the square waves of one excitation signal are orthogonal to those of the other.

Alternatively, the excitation signals can employ wavelets, or any other orthogonal components.

It will be seen that using a preferred embodiment of the invention, the response of a hearing aid can be tested in relatively "real world" conditions, e.g. non-anechoic environments, even where the hearing aid has non-linear and level dependent signal processing circuitry. Since in the preferred embodiment of the invention the primary and secondary excitation signals are presented simultaneously, the level dependent circuitry in the hearing aid 16 is properly excited for assessing the hearing aid response characteristics.

In addition, the hearing aid response can be displayed in real time, so that changes to the directional characteristics can be quickly evaluated.

While normally, it is the acoustic output signal from a hearing aid that will be evaluated, in some cases (e.g. where the hearing aid is under development), its electrical output signal will be available and can be evaluated using the apparatus and method described.

While preferred aspects of the invention have been described, it will be understood that various changes can be made within the scope of the invention.

I claim:

1. Apparatus for testing a directional responding acoustic device, comprising:

(a) at least first and second sound sources adapted to be placed in first and second positions respectively relative to said device, (b) at least one signal generator coupled to said first and second sound sources for generating a first audio signal applied to said first sound source and a second audio signal simultaneously applied to said second sound source, said first and second sound sources generating simultaneous first and second acoustical signals in response to said first and second audio signals applied thereto, (c) said first and second audio signals and hence said first and second acoustical signals each containing a plurality of orthogonal components, the components of said first audio signal being different from the components of said second audio signal, (d) and an analyzer adapted to be coupled to said device and synchronized with said generator, for analyzing the response of said device to said first and second acoustical signals.

2. Apparatus according to claim 1 wherein said components are sinusoids.

3. Apparatus according to claim 1 and including an acoustic receiver located adjacent said device for receiving said first and second acoustic signals, said analyzer being connected to said acoustic receiver, said analyzer being connected to said signal generator for controlling said signal generator.

4. Apparatus according to claim 1, 2 or 3 wherein said analyzer includes a receiver coupled to said device, and a processor coupled to said receiver for analyzing the response of said device to said first and second acoustic signals.

5. Apparatus according to claim 1, 2 or 3 and including at least one further sound source coupled to said signal generator, said signal generator generating a third audio signal for application to said third sound source.

6. Apparatus according to claim 1 wherein said components of said first audio signal comprise first sinusoids which are first bin frequencies of a first Discrete Fourier Transform ("DFT"), and said components of said second audio signal comprise second sinusoids which are second bin frequencies of a second DFT, said first and second DFTs being the same or one DFT being an integer multiple of the other DFT, each of said first bin frequencies being different from all of said second bin frequencies.

7. Apparatus according to claim 6 wherein said first and second DFTs are the same DFT.

8. Apparatus according to claim 7 wherein said first audio signal comprises even bin frequencies and said second audio signal comprises odd bin frequencies of said DFT.

9. Apparatus according to claim 1, 2 or 3 wherein said device is a directional hearing aid.

10. Apparatus according to claim 9 wherein the bandwidth of each of said audio signals extends from approximately 200 Hz to approximately 8 kHz.

11. A method for testing a directional responding acoustic device, comprising:

(a) generating at least first and second audio signals each containing a plurality of components, the components of said first audio signal being different from the components of said second audio signal and being orthogonal thereto, (b) applying said first and second audio signals to first and second sound sources respectively to produce first and second acoustical signals, (c) exposing said device simultaneously to said first and second acoustical signals to produce a received signal, (d) and analyzing the response of said device to said first and second acoustical signals.

12. A method according to claim 11 and including providing a controlling acoustic receiver adjacent said device to provide a control signal, and utilizing said control signal to control the generation of said first and second audio signals.

13. A method according to claim 12 wherein said control signal is applied to a signal analyzer and said audio signals are produced by a signal generator, said method including using said signal analyzer to control said signal generator and synchronizing said signal analyzer and said signal generator.

14. A method according to claim 13 wherein said components of said first and second audio signals are sinusoids.

15. A method according to claim 14 wherein the step of analyzing comprises converting said received signal to the frequency domain using a DFT, and then separating the bin frequencies of said first and second audio signals in said received signal.

16. A method according to claim 11, 12, 13 or 14 wherein each of said first and second audio signals is a broadband audio signal.

17. A method according to claim 11, 12, 13 or 14 wherein said device is a directional hearing aid.

* * * * *